United States Patent [19]

Flumm et al.

[11] B 3,988,885

[45] Nov. 2, 1976

[54] DIGITAL TIMER MEANS AND METHOD OF MAKING THE SAME

[75] Inventors: Paul T. Flumm, Oakville; Vernon B. Harris, Waterbury, both of Conn.

[73] Assignee: Robertshaw Controls Company, Richmond, Va.

[22] Filed: Oct. 21, 1974

[21] Appl. No.: 516,825

[44] Published under the second Trial Voluntary Protest Program on February 3, 1976 as document No. B 516,825.

Related U.S. Application Data

[62] Division of Ser. No. 390,024, Aug. 20, 1973.

[52] U.S. Cl. ..... 58/21.13; 58/22.9

[51] Int. Cl.[2] ..... G04F 3/02

[58] Field of Search ..... 58/21.13, 21.14, 21.15, 58/22.9, 39.5

[56] References Cited

UNITED STATES PATENTS

| | | | |
|---|---|---|---|
| 2,593,905 | 4/1952 | Lux | 58/22.9 |
| 2,721,441 | 10/1955 | Boyles | 58/21.15 X |
| 3,566,599 | 3/1971 | Bassett | 58/21.13 X |

*Primary Examiner*—Lawrence R. Franklin

*Attorney, Agent, or Firm*—Candor, Candor & Tassone

[57] ABSTRACT

A digital timer having a timer mechanism and a drive unit carried by a frame together with a setting device to set a selected period of time that the timer mechanism is to run and for interconnecting the drive unit to the timer mechanism to cause the drive unit to drive the timer mechanism for only that set period of time. The timer mechanism has digital reading members for directly indicating the setting of the timer mechanism to the selected period of time with such digital reading members providing a countdown readout of the set period of time as the same is elapsing.

7 Claims, 8 Drawing Figures

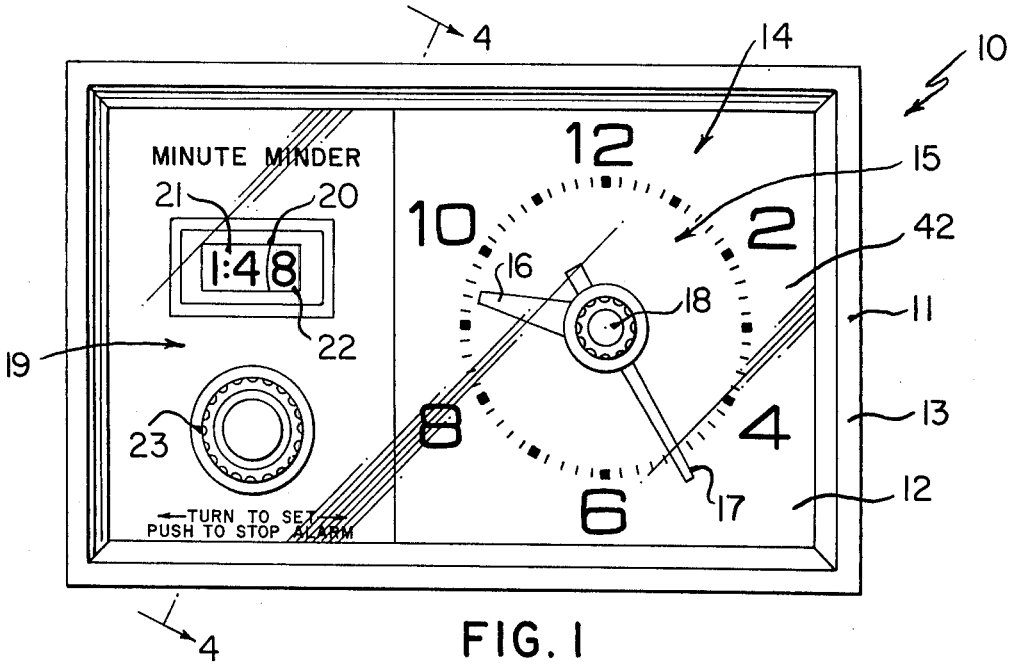
FIG. 1
FIG. 2
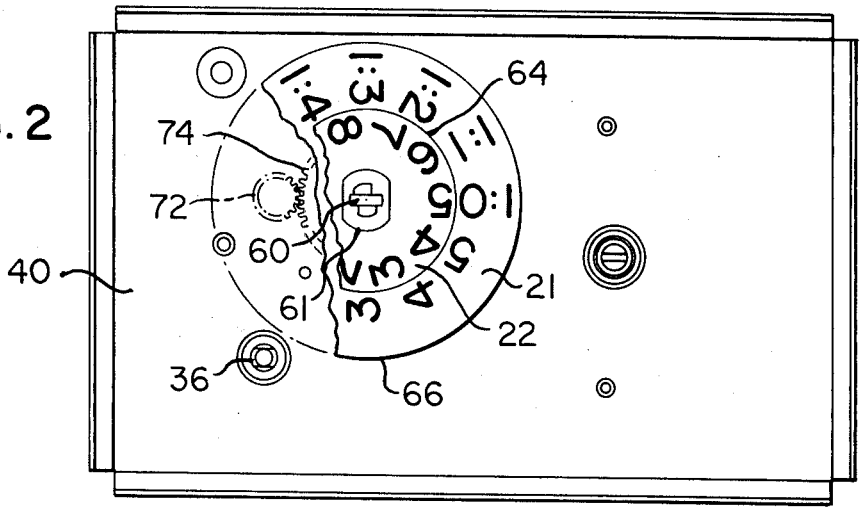
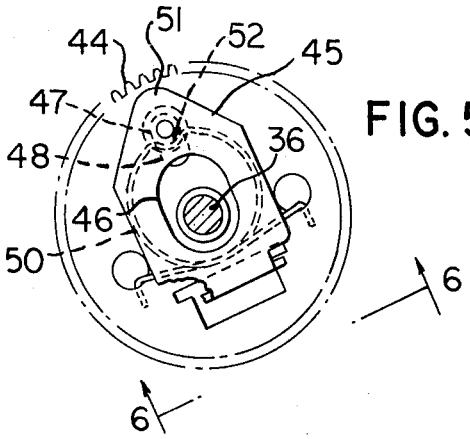
FIG. 5
FIG. 6
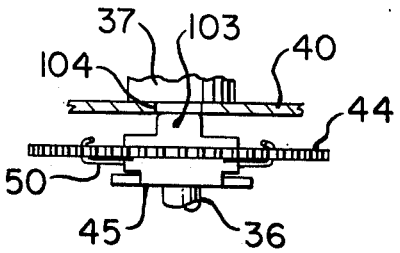

DIGITAL TIMER MEANS AND METHOD OF MAKING THE SAME

This invention relates to a digital timer means and, in particular, to a digital timer means that is adapted to be utilized in combination with a conventional clock structure for providing a range timer on a cooking apparatus or the like.

It is well known that timer units have been provided for cooking apparatus wherein each unit comprises a conventional clock structure provided with rotatable hands for continuously indicating time of day. Usually, in combination with such clock structure, a timer pointer is carried on the same shaft as the clock hands and can be set for anywhere from one minute to sixty minutes. Such pointer will then be driven in a clockwise direction toward the zero or 12 o'clock position by suitable timer mechanism to cause an alarm to sound when the selected time period has completely elapsed to indicate to the user that the selected time period has run out.

It is a feature of this invention to provide a range timer for the above purpose, but having a digital timer means in combination with a conventional clock structure so that the resulting unit can be utilized in combination with a cooking apparatus or the like.

Another feature of this invention is to provide a digital timer that can be utilized by itself or for other purposes as desired.

In particular, one embodiment of this invention provides a frame means carrying a timer means and a drive means with the timer means having setting means for selecting a period of time that the timer means is to run. Such setting means is adapted to cause the unit to interconnect the drive means to the timer means so that the drive means will drive the timer means for only that set period of time. The timer means has digital reading means for indicating the selected set time thereof and for thereafter providing a countdown readout of the set period of time as the same is elapsing.

In this embodiment of the invention, the digital reading means comprises a pair of different sized, concentrically mounted and rotatable discs respectively having time indicating indicia disposed adajcent the outer periphery thereof with the outer peripheries of such discs respectively having adjacent sections thereof being viewable through an opening in a panel structure to provide the indicated time of the timer means.

Accordingly, it is a feature of this invention to provide a digital timer having one or more of the novel features set forth above or hereinafter shown or described.

Another object of this invention is to provide a method for making such digital timer or the like.

Another object of this invention is to provide an improved range timer having one or more of the novel features set forth above or hereinafter shown or described.

Another object of this invention is to provide a method for making such a range timer or the like.

Other objects, uses and advantages of this invention are apparent from a reading of this description which proceeds with reference to the accompanying drawings forming a part thereof and wherein:

FIG. 1 is a front view of the improved range timer of this invention with the digital timer thereof set for a time period of 1 hour and 48 minutes.

FIG. 2 is a front view of the range timer illustrated in FIG. 1 with the front panel removed and part of the timer discs broken away to expose structure behind the same, the digital timer of FIG. 2 being disposed in the zero time or "off" position thereof.

FIG. 5 is a fragmentary, cross-sectional view taken on line 5—5 of FIG. 4.

FIG. 6 is a fragmentary, cross-sectional view taken substantially in the direction of the line 6—6 of FIG. 5.

Figure 3:
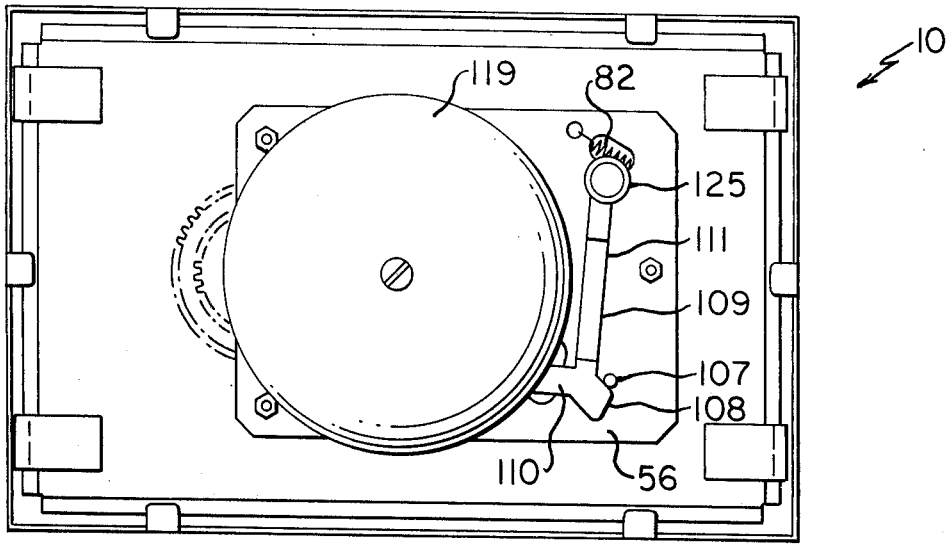
FIG. 3 is a rear view of the range timer illustrated in FIG. 1.

While the various features of this invention are hereinafter described or illustrated as being particularly adapted to provide a digital timer for use with a time of day clock structure for providing a range timer for a cooking apparatus, it is to be understood that the various features of this invention can be utilized singly or in any combination thereof to provide a digital timer for use by itself or in combination with other structures as desired.

Therefore, this invention is not to be limited to only the embodiment illustrated in the drawings, because the drawings are merely utilized to illustrate one of the wide variety of uses of this invention.

Referring now to FIG. 1, the improved range timer construction of this invention is generally indicated by the reference numeral 10 and comprises a frame structure generally indicated by the reference numeral 11 and having a front dial plate or panel 12 and a bezel 13, the frame 11 having means for mounting the range timer 10 to a control panel of a conventional cooking apparatus in a manner well known in the art.

The range timer construction 10 includes a time of day clock means that is generally indicated by the reference numeral 14 and comprising a clock face disposed on the front panel 12 and having an hour hand 16 and minute hand 17 concentrically mounted to indicate time of day in combination with the dial face 15 in a conventional manner. The clock structure 14 is adapted to have the hands 16 and 17 thereof set by a selector knob 18 in a manner conventional in the art.

The range timer construction 10 includes a digital timer of this invention that is generally indicated by the reference numeral 19 and comprises a substantially rectangular window 20 formed through the front panel 12 and exposing sections of a pair of concentrically mounted, different sized discs 21 and 22 operated in a manner hereinafter described to be set to a desired indicating time period by a selector knob 23 rotated in either a clockwise or counterclockwise direction to set the selected time period for the timer means 19. The selected time period for the timer means 19 illustrated in FIG. 1 is 1 hour and 48 minutes. The selected time period of the timer means 19 is directly selected by the selector knob 23, as will be apparent hereinafter, and when the selector knob 23 is released from the desired timer setting, the discs 21 and 22 are operated by timer means in the manner hereinafter described to provide a minute by minute digital countdown of the elapsing time period and when the discs 21 and 22 subsequently indicate the zero position "00", the timer means is automatically disconnected from the discs 21 and 22 and an alarm is provided by the range timer 10 in the form of a bell 119, FIGS. 3 and 4, being repetitively hit by an oscillating hammer member 125 in a manner hereinafter described until the operator pushes inwardly on the selector knob 23 in a push button manner as will be apparent hereinafter to terminate the sounding of the alarm. At this time, the digital timer means 19 remains dormant until again set for a new time period.

Therefore, it can be seen that the range timer means 10 of this invention provides a digital timer means 19 completely separate from the conventional clock means 14 so that the housewife or the like will not have to bother with the conventional clock means 14 to set the desired time period for digital timer means 19 and the digital timer means 19 will directly indicate the selected time by a digital readout arrangement thereof that is completely separate from the conventional clock means 14. Such digital reading means of the timer means 19 will thereafter continuously indicate a digital countdown of the elapsing time period so that the housewife or the like will know how much of the selected time period remains during the running thereof.

The details of the parts and the details of the operation of the range timer construction 10 previously and generally described will now be described in connection with the remaining figures of the drawings.

Figure 4:
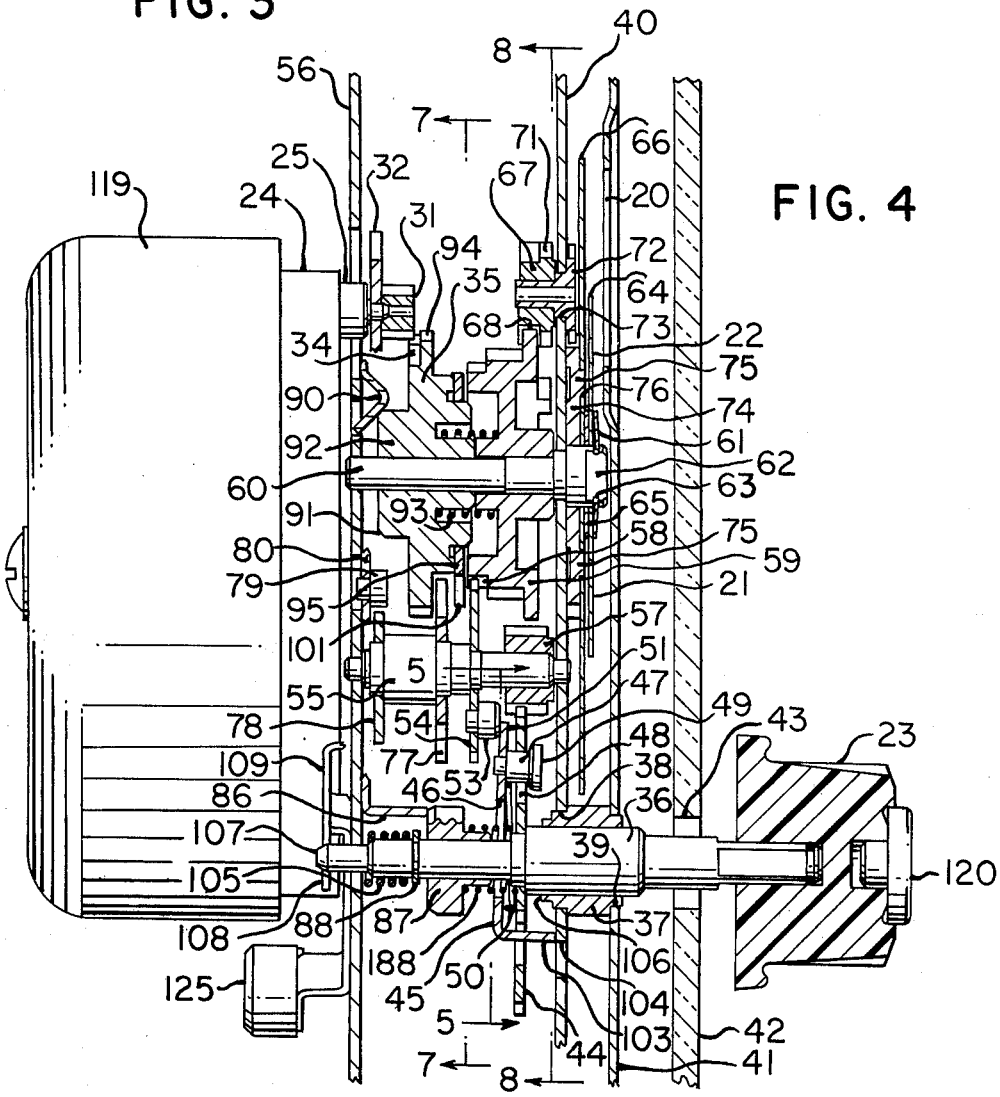
FIG. 4 is an enlarged, fragmentary, cross-sectional view taken substantially on line 4—4 of FIG. 1 and illustrates the digital timer disposed in the zero position thereof.
Figure 7:
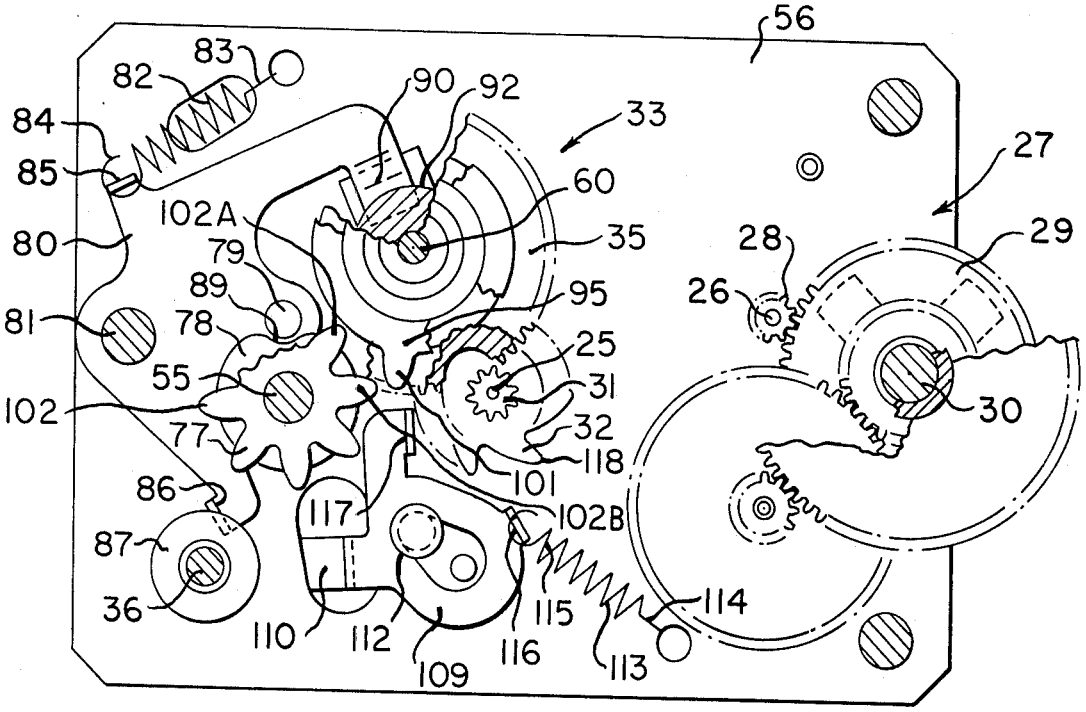
FIG. 7 is a fragmentary, cross-sectional view taken substantially in the direction of line 7—7 of FIG. 4.

As illustrated in FIGS. 4 and 7, a synchronous motor and gear unit 24 is carried by the frame means 11 and has two geared outlet shafts 25 and 26 respectively driven at speeds of 6 revolutions per minute and 1 revolution per 10 minutes. The output shaft 26 of one revolution per ten minutes rotates counterclockwise in FIG. 7 and is used for driving the clock mechanism that is generally indicated by the reference numeral 27 in FIG. 7 and comprising a pinion gear 28 fixed to the shaft 26 and being disposed in meshing relation with a gear wheel 29 clutched to the setting shaft 30 of the clock 14.

Since the clock structure 14 is adapted to have the hands 16 and 17 thereof driven, in effect, by the output shaft 26 of the motor 24 in a conventional manner and is adapted to have the time setting thereof set in a conventional manner by the knob 18, further details of the structure and operation of the clock 14 is considered unnecessary to understand the features of this invention which are directed to the digital timer means 19 utilized in combination with the clock 14, in combination with other structures, or by itself, as desired.

Thus, it can be seen that it is only necessary to state that the synchronous motor 24 is adapted to provide the drive for the conventional clock means 14 as well as for the digital timer means 19 of this invention in a manner hereinafter described.

Figure 8:
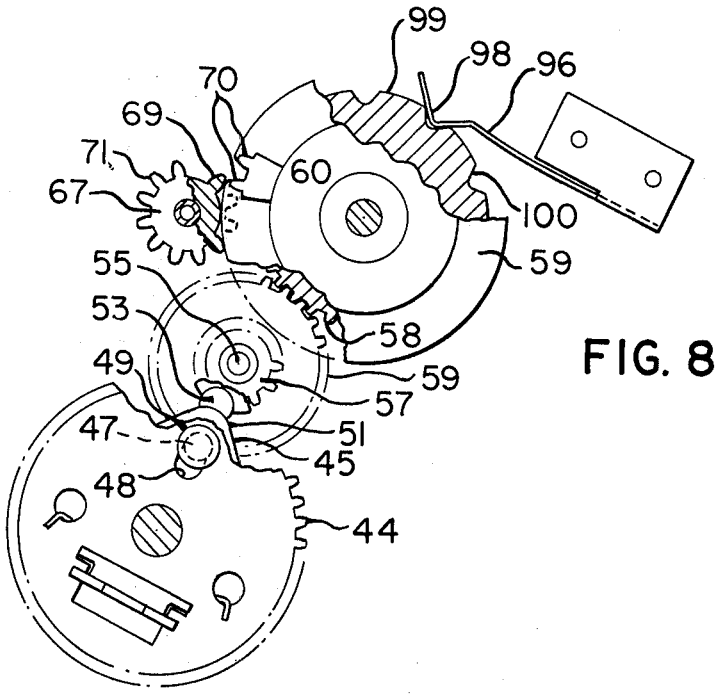
FIG. 8 is a fragmentary, cross-sectional view taken substantially in the direction of the arrows 8—8 of FIG. 4.

A pinion gear 31 and ratchet wheel 32 are respectively attached as drive fits to the continuously rotating 6 rpm output shaft 25 of the motor 24, the shaft 25 having a clockwise rotation as illustrated in FIG. 7. As illustrated in FIG. 7, the timer mechanism for the digital timer means 19 is generally indicated by the reference numeral 33 and is illustrated in FIGS. 4, 7 and 8 as being in its "off" or zero position. Thus, the pinion gear 31 is continuously rotating within a cutout 34 formed in the outer periphery of a molded gear 35. Therefore, with the drive means 33 disposed in its off position, no drive is imparted from the continuously rotating drive means 31 to the timer mechanism 33 of the timer means 19.

As illustrated in FIG. 4, the setting knob 23 for the digital timer means 19 is attached to a setting shaft 36 which is rotatably mounted to the frame means 11 by a bearing means 37 staked in suitable openings 38 and 39 formed respectively in frame plate 40 and dial plate 41, the frame plate 41 providing on the front side thereof the front dial 12 of the range timer means construction 10 which is adapted to have a transparent plate 42 disposed in front of the same as illustrated in FIG. 4, whereby the setting shaft 36 projects out of an opening 43 formed in the window material 42 in a conventional manner.

The setting shaft 36 has a gear wheel 44 staked thereto and cooperates with a slider member 45 having an oblong opening 46 formed therethrough and receiving the setting shaft 36 therethrough. The slider member 45 has a pin 47 fastened thereto and projecting through an elongated slot 48 formed in the gear wheel 44 and being held captive thereto by an enlarged rivet-like head 49 on the pin 47. A formed wire spring 50 provides a bias to the slider pin 47 and thus to the slider member 45 in two different planes. In particular, the spring 50 provides a bias in a direction whereby a radiused tip or end 51 of the slider member 45 is moved or pressed to its furthermost position from the longitudinal axis of the setting shaft 36, or to the left as illustrated in FIG. 5, because of a circular loop 52 thereof bearing against the righthand side of the pin 47 as illustrated in FIG. 5. The spring 50 also provides a bias in a plane whereby the head 49 of the slider pin 47 tends to engage against the gear wheel 44. However, the slider member 45 is illustrated in FIG. 4 as being in a raised position by being disposed on top of an operating pin 53 that is attached to a gear wheel 54 fixed to a shaft 55 rotatably mounted between the frame plate 40 and a back frame plate 56 of the frame means 11.

As the setting shaft 36 is rotated by the knob 23, the gear wheel 44 attached thereto is also caused to rotate in unison therewith and is disposed in meshing relation with a gear wheel 57 that is fixed to the shaft 55. Thus, the gear wheels 57 and 54 rotate upon rotation of the setting shaft 36 causing the operation pin 53 to rotate out from under the radiused end or tip 51 of the slider member 45 whereby it can be seen in FIG. 8 that by the rotation of the two shafts 36 and 55, the slider member 45 will disengage from the operating pin 53 upon a rotation of the setting shaft 36 in either a clockwise or counterclockwise direction. Such setting mechanism 36 is arranged so that for a setting of one minute on the timer means 19 by rotation of the shaft 36 in either direction, the slider member 45 will disengage from the operating pin 53 and will move to a position wherein the head 49 of the slider pin 47 engages against the gear wheel 44. This will cause the radiused end or tip 51 of the slider member 45 to move to a position within the same plane as the movement of the operating pin 53 of the gear 54.

The gear ratios of the two gears 44 and 57 are so arranged that one full turn of the setting shaft 36 is equivalent to the setting of 30 minutes of the digital timer 19 and this causes the shaft 55 to rotate three and three-quarters of a turn, or at a rate of one revolution for each 8 minutes of setting of the shaft 36.

These respective rates of revolutions are utilized for the purpose of obtaining multiple revolutions of the setting shaft 36 between successive points of engagement of the slider member 45 with the operating pin 53. With the structure assembled for inline engagement of the slider member 45 with the operating pin 53 at 0 minutes of the timer means 19 as illustrated in FIG. 8, the digital timer 19 may be set by the knob 23 for a period up to 120 minutes before this inline arrangement of the pin 53 and slider member 45 will reoccur. Thus, a setting of two hours for the timer means 19 is therefore equivalent to returning the mechanism to a zero setting and for this reason, the maximum setting time for the particular embodiment of the digital timer means 19 of this invention is 1 hour and 59 minutes as will be apparent hereinafter.

The gear 54 that carries the operating pin 53 is disposed in meshing relation with gear teeth 58 of a molded gear 59 that is fixed to a shaft 60 rotatably mounted between the frame plates 40 and 56 as illustrated, the shaft 60 loosely receiving and thereby rotatably mounting the previously described gear 35 to the frame means 11. The timer disc 22 that has a section thereof viewably at the window 20 in the front panel 12 or frame plate 41 is fastened for rotation to the shaft 60 by two flats on the shaft 60 and is retained on the shaft by a spring clip 61. The spring clip 61 is assembled by being set on the end 62 of the shaft 60 and is depressed against its bowed spring tension and given one quarter of a turn in a clockwise direction to retain it is an appropriate groove 63 in the end 62 of the shaft 60. Of course, the disc 22 can be fastened to the shaft 60 to rotate in unison therewith in any desired manner.

Numerals from 0 to 9 are printed on the indicator disc 22 adjacent its outer periphery 64 to respectively represent unit minutes that are to be viewed through the aperture or window 20 in the dial or front plate 12.

A thin spacing washer 65 is positioned on the end 62 of the shaft 60 for the purpose of preventing the discs 22 and 21 from scraping each other or having excessive frictional contact therebetween.

The indicator disc 21 is printed with the numerals from 0 to 5 and from 1:0 to 1:5 to indicate the tens of minutes readings about the outer periphery 66 thereof so as to be respectively readable in the window 20 as illustrated in FIG. 1.

The molded gear 59 is disposed in engagement with a special die cast gear 67, FIGS. 4 and 8, the gear 67 originally being a 12 toothed gear in a plane adjacent to the frame plate or pan 40 and has eight of those teeth removed on one side of the gear 67 to become a four toothed gear in a plane similar to that for the rim 68 of the gear 59, such remaining teeth of the gear 67 being indicated by the reference numeral 69 in FIG. 8. Two teeth 70 project above the surface of the rim 68 of the gear 59 so as to lay within the same plane as the 12 teeth 71 of the gear 67 to provide a means of locking in an increment drive between the gears 59 and 67.

A pinion gear 72 is assembled as a free running fit through an opening 73 in the plate 40 and is staked to the gear 67 to rotate in unison therewith. The gear 72 is disposed in mesh with a gear wheel 74 disposed in a free running fit on the shaft 60 and retained in position by the plate 40 and the spacing washer 65. Two extruded dowels 75 on the gear 74 are received in complementary openings 76 formed through the disc 21 whereby the indicating disc 21 is fastened for rotation with the gear 74 and may be further fixed thereto by adhesive or other suitable means.

Thus, it can be seen that for each revolution of the shaft 60, the unit minute indicator 22 will move through successive readings from 0 to 9 and by synchronizing the printing and respective gear meshes, the tens of minutes indicating disc 21 will be caused to change its reading one increment in an appropriate manner when the reading changes from 9 back to 0 on the indicating disc 22. In fact, in practice, the numbers of both discs 21 and 22 move together during a change in reading of the tens of minutes.

Accordingly, the setting knob 23 for the timer means 19 can be turned clockwise for increasing readings of minute settings as 0, 1, 2, 3, etc. or counterclockwise for decreasing readings as 1:59, 1:58, 1:57, etc. of the discs 21 and 22 at the window 20 of the timer means 19 when it is desired to set the timer means 19 for a desired time period.

The shaft 55 has an eight toothed gear 77 fixed thereto and a cam wheel 78 fixed thereto whereby the gear 77 and cam wheel 78 will be rotated during the setting of the timer means 19.

As illustrated in FIGS. 4 and 7, an arming pin 79 is carried by a stop lever 80 so that when the cam wheel 78 is caused to rotate from its zero position upon a setting of the setting shaft 36, the cam plate 78 will raise the arming pin in FIG. 7 and therefore cause the stop lever 80 to pivot on a post or pillar 81 that is carried by the back plate 56 and comprises one of the posts that supports the frame plates 56 and 40 in spaced relation so as to move to a set position against the force of a tension spring 82 having one end 83 secured to the back plate 56 and the other end 84 fastened to an ear 85 of the lever 80.

The lever 80 has a bent ear 86 normally disposed against a plunger 87 loosely disposed on the setting shaft 36 and normally urged toward a retaining ring 88 carried by the setting shaft 36 by a compression spring 188 as illustrated in FIG. 4. Thus, when the lever 80 is cammed in a counterclockwise direction in FIG. 7 by rotation of the cam wheel 78, the tang or ear 86 moves out from engagement with the plunger 87 whereby the plunger 87 will move against the retaining ring 88 by the force of the compression spring 188 and thereby prevent the stop lever 80 from returning to its original position as the ear 86 will engage against the side of the plunger 87 even though the notch 89 in the cam 78 is again in alignment with the arming pin 79 of the lever 80 as illustrated in FIG. 7.

The lever 80 has a V-shaped part or rib 90 normally disposed in engagement with a chamfer 91 on a hub 92 of the gear 35 so that when the lever 80 is cammed in a counterclockwise direction in FIG. 7 by the cam 78 acting on the arming pin 79, the rib 90 is moved away from the chamfer 91 of the gear 35 so that the gear 35 is now free to move against the back plate 56 under the influence of a compression spring 93 actng between the gears 35 and 59.

As the gear 35 is moved toward the back plate 56 by the compression spring 93, the gear teeth 94 of the gear 35 that have not been removed by the cutout 34 are lowered on to the top of the motor output pinion gear 31. It is not important whether or not the synchronization of mesh of the teeth 94 of the gear 35 with the teeth of the gear 31 is achieved instantaneously because the gears 35 and 31, being of a proportion of 10 teeth to 60 teeth respectively, represent 1 second per tooth for each of the motor output pinion 31 and the one rpm gear 35. Therefore, no more than an interval of time of less than 1 second can be lost as a result of any lapse in the time before the respective gears 35 and 31 achieve an effective meshing action to permit the gear 35 to move against the backup plate 56 and be directly driven by the drive pinion 31.

As the gear 35 is moved toward the back plate 56 by the compression spring 93, a single tooth driving dog 95 that is attached to the gear 35 is lowered into the same plane as the eight toothed gear 77 fixed to the shaft 55. Due to its initial starting position and its direction of rotation, which is counterclockwise in FIG. 7, the driving dog 95 will not impart any restriction to the free rotation of gear 77 for a period of time equal to approximately 50 seconds from the commencement of the setting of the shaft 36 for a setting of a time period for the timer means 19.

While in the previous description of the setting of the timing means 33 for the digital timer means 19, all of the components have been free to move without any mechanical resistance other than the arming of the stop lever 80 against the force imposed by its associated spring 82 and by the very small friction of the gear meshes, it may be desired to provide a means of accurate positioning for the numbers on the discs 21 and 22 during a setting thereof whereby an incremental positioning means has been incorporated for the digital timer means 19 as illustrated in FIG. 8.

In particular, a formed leaf spring 96 has an elbow 98 thereof exerting a very light pressure against an outer peripheral surface 99 of the gear member 59 so as to be received respectively in notches 100 at each numeral setting at the window 20 of the range timer 10. Although the detents or notches 100 do not join one another in a continuous uninterrupted sequence, but possess null positions between adjacent settings, it is found in practice that the "feel" of the setting mechanism is such that the natural tendency is to move from one notch 100 to the next whereby it requires a very deliberate intent and action of the operator to produce a half-way setting between the notches 100 and, thus, a half-way setting numbers at the window 20. Such a half-way setting, however, does not provide for any increment of a minute in the running time of the unit 19 as will be apparent hereinafter and such half-way setting will not cause any damage to the unit 19 as will be apparent hereinafter.

As previously stated, it is considered that the 50 seconds of running time for commencement of the setting of the timer means 19 by the shaft 36 before the driving dog 95 moves its single tooth 101 into a position for its first engagement with a gear tooth 102A of the gear 77 is more than adequate time for achieving an initial setting of the timer unit 19 by the operator. However, when the driving dog 95 does have its tooth 101 rotated into contact with a tooth 102 of the gear 77, the amount of drive during which the driving dog 95 is actually driving gear 77 is approximately five seconds whereas the time in which the driving dog 95 is actually within the track of gear 77 is a slightly longer period of time. Thus, it can be seen in FIG. 7 that one tooth 102A of the gear 77 is in a slightly offset position from a line drawn between the center of the two shafts 55 and 60. This position for the gear 77 is determined by the runout of the driving dog tooth 101 from its previous engagement with the tooth 102B and by the positioning detents 100 of the gear 59. With the gear 77 in the position as illustrated in FIG. 7, it can be seen that the tooth 101 of the driving dog 95 will clear the tooth of gear 77 which is disposed in a position approximately symmetrical to that of tooth 102B and will subsequently engage with tooth 102A to drive the gear 77. In the event of a change of setting being made during the running time of the unit, this is accomplished during any period of approximately 50 seconds during which time the driving dog 95 is not moving its tooth 101 within the track of the teeth 102 of gear 77. If, however, this engagement should commence during the time of resetting the unit 19, it will be necessary to wait for the completion of the engagement between the dog 95 and the gear 77 before completion of the resetting operation. However, it is to be understood that any means can be provided within the mechanism 33 for overriding the mechanical drive between the dog 95 and gear 77, if desired.

Thus, it can be seen that the shaft 55 is caused to rotate one-eighth turn for each rotation of the dog 95 which occurs once every minute of running time. Thus, the change of numerals on the discs 21 and 22 will take place as follows.

Approximately 52 seconds after the commencement of setting of the timer means 19 to a desired time period by the setting knob 23, the numerals of the indicating discs 21 and 22 finally set at the window 20 of the selected time period will change by one increment over a period of time of approximately 5 seconds. This change in numerals will reoccur thereafter at intervals of 60 seconds until the completion of the set running time for the timer mechanism 33.

Thus, during the set running time for the timer mechanism 33, the timer mechanism 33 will remain stationary for approximately 55 seconds of each minute and then move at a rate equivalent to a minute division over a period of approximately 5 seconds of drive. This feature, combined with the permutation of revolutions of the slider member 45 and the operating pin 53 provides the following advantages.

During the setting of the timer unit 19, the setting knob 23 is rotated at a rate equivalent to 30 minutes of setting for each complete rotation of the setting knob 23, a rate that is believed to be a convenient rate for obtaining a particular timer setting. Also, with the combination of two way setting of the knob 23 and permutated revolutions, a setting of up to 1 hour and 59 minutes may be achieved without an undue number of revolutions of the setting knob 23 and in the 50 second time before the driving dog 95 initially begins to incrementally drive the gear 77 and, thus, the discs 21 and 22 back to their zero position. However, during the running time for the timer unit 19, the setting shaft 36 advances in increments of 1/30 of a turn over periods of approximately 5 seconds back to its original rotational position. Thus, the setting shaft 36 moves at a rate of one revolution per 2 minutes and 30 seconds during its periods of incremental movement, for an interval of 30 minutes of elapsing timer time to provide a comparatively fast speed for its drop-off position at the end of the timed run as will be apparent hereinafter whereby this combination of features provides a very accurate means of timing for a comparatively long running time mechanism.

The operation of the digital means 19 for an initial setting of a selected time period will now be described.

When the operator grasps the knob 23 and rotates the same in either a clockwise or counterclockwise direction to cause the indicating discs 21 and 22 to move in the window 20 represent the desired time period that the timer 19 is to run for a timing operation, rotation of the shaft 36 causes the gear 44 to rotate the shaft 55 through the meshing of the gear 44 with the gear 57. Rotation of the gear 44 and the gear 54 of the shaft 55 thereby moves the pin 53 from beneath the slider member 45 so that the slider member 45 moves to the left in FIG. 4 to have its end 51 disposed in the same plane as the pin 53. The rotation of the shaft 55 also causes the cam member 78 to cam the lever 80 in a counterclockwise direction in FIG. 7 to move the tang 86 away from the plunger 87 so that the plunger 87 is moved against the retaining ring 88 by the force of the compression spring 188 to prevent the lever 80 from returning to the position illustrated in FIG. 7. Such movement of the lever 80 moves the rib 90 away from the hub 92 of the gear 35 so that the gear 35 now moves by the spring 93 into meshing relation with the pinion 31 so as to be rotated thereby. However, it takes one complete revolution of the gear 35 before the single tooth 101 of the driving dog 95 meshes with a tooth 102 of the gear 77 so that no drive is imparted to the shaft 55 by the drive motor 24 for approximately 50 seconds from the time the gear 35 is initially driven by the drive pinion 31 for the reasons previously described. The setting rotation of the shaft 55 by the setting shaft 36 causes the gear 54 to rotate the gear 59 as the teeth 58 of the gear 59 are disposed in mesh with the teeth of the gear 54. Such rotation of the gear 59 causes the unit minute indicator disc 22 to rotate and serially position the numbers thereon in the window 20 while the disc 21 is caused to rotate one increment each time the gear 59 is rotated one complete revolution as the pair of teeth 70 of the gear 59 only makes contact with one of the teeth 71 on the pinion gear 67 after each revolution of the gear 59. Thus, one revolution of the gear 59 causes the gear 67 to move and through its interconnected pinion gear 72 that is disposed in mesh with the teeth on the gear 74 that is interconnected to the timing disc 21, the tens of minutes indicating disc 21 will change its indication every time the disc 22 moves one complete revolution. Thus, once the desired time period appears in the window 20, such as the 1 hour and 48 minute setting illustrated in FIG. 1, the operator releases the shaft or knob 23 and the timer mechanism 33 will begin to run down in a digital countdown manner for the set time period in the following manner.

As the driving dog 95 is now being rotated by the gear 35 being rotated by the driving pinion 31, its tooth 101 will at every revolution of the driving dog 95 make contact with a tooth 102 of the gear 77 and cause the same to rotate one-eighth of a turn and thereby cause the shaft 55 to rotate one-eighth of a turn. Such incremental rotation of the shaft 55 causes its gear 54 to rotate and, thus, the gears 59 and 67 to rotate and function in the manner previously described to provide a run down of the time indicated in the window 20 so that the discs 21 and 22 will be incrementally run back toward the zero position therefor which will occur in approximately 1 hour and 48 minutes from the initial setting thereof by the knob 23.

When the timer mechanism 33 has been driven to a position in which the operating pin 53 on the gear 54 is brought into a position of engagement with the end 51 of the slider member 45 during the run down of a selected time period for the timer means 19, the slider member 45 is deflected in a rightward radial movement in FIG. 5. on the shaft 36 with respect to the gear 44. However, gear 44, also being simultaneously driven by the gear 57 during the rotation of the shaft 55, causes a tongue 103 on the slider member 45 to move across the face of the frame plate 40 until the tongue 103 enters a slot 104 formed through the frame member 40. With the slider 45 in this new position, the setting shaft 36 is free to move in an axial direction to the right in FIG. 4 under the influence of a compression spring 105 disposed between the back plate 56 and the retaining ring 88. Thus, the shaft 36 moves to the right in FIG. 4 until the gear 44 carried thereby comes into engagement with the end 106 of the bushing 37. This action moves the tip 51 of the slider 45 beyond the top of the operating pin 53 and although the slider member 45 cannot return to its fully extended position relative to the gear 44 by the spring 50, due to the engagement of the tongue 103 against the innermost edge of the slot 104, the tip 51 of the slider member 45 will nevetheless move partially across the top of the operating pin 53.

The plunger 87 which has previously been restraining the stop lever 80 from returning to its original "unset" position as illustrated in FIG. 7, is now lifted out of engagement with the tang 86 of the lever 80 so that the spring 82 causes the lever 80 to move in a clockwise direction in FIG. 7 wherein the tab 86 moves to a position in alignment with the plunger 87 as illustrated in FIG. 4 and the stop lever pin 79 moves into the notch 89 of the cam wheel 78. The rib 90 of the stop lever 80 also moves into engagement with the chamfer 91 of the gear wheel 35 and cams the same on the shaft 60 away from the end plate 56.

At the instant in which the drive has been transmitted from the driving dog 95 to the gear 77 sufficient to cause the setting shaft 36 to move to the right in FIG. 4 in the manner previously described, the driving dog 95 has completed its function but still remains within the track of the teeth 102 of the gear 77. If the tooth 101 of the driving dog 95 should remain in this position, it would provide a locking condition when the unit 19 was reset to a new timing condition thereof. However, this problem is overcome because as the gear 35 is raised by the action of the stop lever 80 returning to its normal position, the driving dog 95 is also lifted away from the back plate 56 a distance which is sufficient to move the tooth 101 of the driving dog 95 out of the plane of the teeth 102 of the gear 77. Although the gear 35 has been moved away from the end plate 36, its gear teeth 94 are still within the same plane as the teeth of the motor output pinion 31 as the cutout 34 thereof has not reached the pinion 31. Therefore, the gear 35 will continue to rotate under the influence of the driving 31 causing the driving dog 95 to move its gear tooth 101 to a position which is outside of the track of the teeth 102 of the gear 77 as illustrated in FIG. 7. In this position of the driving dog 95, the motor output pinion 31 ceases to drive the gear 35 as the cutout 34 of the driving gear 35 has now reached the pinion gear 31.

This additional running time of the gear 35 after the final drop off is equal to approximately 3 seconds and therefore this amount of time is deducted from the running time of the unit for any setting thereof.

One problem which would appear to be inherent for any mechanical incremental mechanism to be used for a digital minute timer, compared to continuous running timers, is that the event of cancellation of a setting, a continuously rotating member which provides the time base for controlling the mechanism and which in this instance is the assembly comprising the gear 35 and driving dog 95, may be in an infinitely variable position. If this member should remain in this indeterminate position, it would not provide a correct running time for the unit on its next setting. This problem is increased due to the basic requirements for the times at which the numbers are moved during each minute. For any setting of the indicator discs 21 and 22, this setting will remain visible for the greater portion of one minute and then be driven to its next lowest reading during the last few seconds at that minute. Therefore, a reading of 01 will not commence to change to 00 until the mechanism is within approximately 5 seconds of its final drop-off position. Thus, when a setting has been cancelled, the mechanism will probably be in a position whereby it is necessary for the driving dog 95 to traverse the position in which it would normally operate one further change of numeral before reaching its datum off position. If no suitable provision has been made to counteract this tendency, the mechanism would continue to drive to a reading of 1:59 and therefore run for this further time.

This problem does not normally occur in the design of continuously running timers and is believed to be unique in respect to prior art in the areas of clocks and timers. However, the timer mechanism of this invention has been designed to overcome this problem. In particular, the operation of the digital timer means 19 after cancellation of a time setting thereof has occurred is as follows.

When a setting has been made on the digital timer means 19 and then is cancelled by the operator turning the shaft 23 to position a zero setting in the window 20, the gear 35 will have been moved toward the back plate 56 and then driven to some position other than its normal "start" position. However, when the unit is reset to read 00, the stop lever 80 will immediately raise the gear 35 away from the back plate 36 and gear 35 will continue to be driven by the motor output pinion 31 and therefore will not impart any drive to the rest of the mechanism as the driving dog 95 is raised out of the plane of the gear 77. Thus, the gear 35 will be driven to its normal start position as shown in FIG. 7 and will come to rest in this position due to the cutout 34 in the gear face 94 of the gear 35 receiving the drive pinion 31.

Therefore, it can be seen that when the shaft 36 is rotated by the knob 23 to the 0 setting in the window 20, the indicator discs 21 and 22 will not be further driven even though the gear 35 may be further driven by the drive motor 24 in the manner previously described.

The further operation of the timer means 19 at the instant of completion of a normal timed run of the timer means 19 will now be described.

The end part 107 of the setting shaft 36 which projects beyond the end plate 56 to the left thereof as illustrated in FIG. 4, has originally been in engagement with a tab 108 of a hammer lever 109 pivotally mounted to the back plate 56 by a leg 110 thereof passing through an opening in the back plate 56, another leg 111 of the lever 109 carrying the hammer 125 on the outer end thereof. As the setting shaft 36 moves to the right in FIG. 4 upon the completion of a timed cycle in the manner previously described by the force of the compression spring 105 as the tang 103 of the slider member enters the slot 104, the end 107 of the shaft 36 disengages from the tab 108 whereby the hammer lever 109 is pivoted on a shoulder pin 112, FIG. 7, carried by the back plate 56.

A spring 113 has one end 114 interconnected to the back plate 56 while the other end 115 is fastened to an ear 116 of the lever 109. Thus, spring 113 not only provides a tortional bias to the hammer lever 109, but also the spring 113 is angled between its attachment with the back plate 56 and its anchorage at the top of the tab 116 to provide a downward pressure on the lever 109. When the tab 108 is released from its engagement with the setting shaft 36, the hammer lever 109 is free to move under the influence of the spring 113. Another tab 117 on the lever 109 now moves into engagement with the teeth 118 of the rachet wheel 32 that rotates at 6 rpm. Due to the respective features of the form of the teeth 118 of the rachet wheel 32 and the pivoting position of the hammer lever 109, the hammer lever 109 is induced to lift slowly and fall rapidly due to the tortional register of tension imparted by the spring 113 and this action of the hammer weight 125 is induced to strike the bell 119 in a series of blows to produce a continuous chiming action and thus signal the end of the time period of the timer means 19.

This ringing of the bell 119 continues until shut off by utilizing the setting knob 23 in a manner now to be described.

A decorative button 120 is carried by the setting knob 23 so as to provide obvious press button appearance in addition to appropriate instructions which are printed on the dial face 12 as illustrated in FIG. 1 concerning the alarm shutoff. Such button 120 also provides illusion of a shutoff mechanism operated independently of the setting knob 23.

Therefore, when the operator pushes in on the button 120, the entire setting shaft assembly 36 is moved toward the back plate 56 with the exception of the plunger 87 which remains seated on the top of the tab 86 of the lever 80 and the radiused tip 51 of the sliding member 45 which remains on top of the operating pin 53. As the tongue 103 of the sliding member 45 is removed from the slot 104 in the plate 40, the slider member 45 is now free to move to its outer most radial position from the setting shaft 36 under the force of the spring 50 whereby the tongue 103 now moves radially to a position away from its innermost edge of the slot 104. Then as the press button 120 is released, the tongue 103 of the sliding member 45 will now prevent the setting assembly 36 from returning to its outer position as the tongue 103 of the slider member 45 now abuts against the plate 40 as illustrated in FIG. 4.

As the setting shaft 36 and its assembly is depressed by the pushing inwardly on the button 102, the chamfered end 107 of the shaft 36 will engage the tab 108 of the hammer lever 109 and deflect the plane of the hammer lever 109 away from its flat contact with the back plate 56. The ratchet wheel 32, being in continuous engagement with the tab 117, will continue to rotate the hammer lever 109 to the maximum position of "lift" for the ratchet teeth 118 whereby in this position of the hammer lever 109, the tab 108 will be in a position whereby the edge of the tab 108 engages with the chamfered end 107 of the setting shaft 36. Due to the two vectors of tension which are supplied by the spring 113, the hammer lever 109 is continuously subjected to a force tending to return it to its flat contact with the back plate 56. As a result the positions of the hammer lever 109 and the setting shaft 36, and the vectors of spring tensions of the spring 113 which are involved, the tab 108 is induced to return to its previous position as illustrated in FIGS. 3 and 4 whereby the timer unit 19 is now reset to its original position as illustrated respectively in FIGS. 2–8.

Thus, it can be seen that the digital timer means 19 operates in a manner to run down from the set period of time thereof to the 00 position wherein the bell 119 will then be continuously operated until the operator pushes in on the push button 120 of the set knob 23 to terminate the alarm and reset the setting shaft 36 thereof.

If any attempt is made to change a setting of the digital timer 19 during the normal running thereof or any attempt is made at misuse of the unit 19 by setting the indicated numbers in unusual positions in the dial window 20 so that the unit 19 is set to read halfway between numbers, the unit 19 will not measure odd increments of minutes. For example, for a setting of 5 ½ minutes whereby the numbers 5 and 6 on the disc 22 are both visible in the dial aperture 20, the teeth 102 of the gear 77 will be displaced from their position as shown in FIG. 7 by half a pitch. As the tooth 101 of the driving dog 95 enters this configuration, it will commence to drive a tooth 102 of the gear 77 at a position which is prior to its normal point of engagement. At this position it would not constitute a jamming situation but would commence driving the mechanism for a time equivalent to 1 ½ pitches of the teeth 102 on the gear 77. This action would cause the numbers in the dial aperture 20 to move from their previous positions to now indicate a reading of 4 whereas the total length of the timed run would be 5 minutes.

Due to the shape of the teeth 102 on the gear 77 and the tooth 101 on the driving dog 95, the tendency for any jamming of these teeth to occur by producing a butting condition from mis-settings is very remote. However, there is one critical position where this can be achieved but even under these circumstances, the unit 19 is not damaged. Due to the comparatively fast speed of the motor output shaft 25 of 6 rpm, there is very little gearing between the shaft 25 and the rotor of the synchronous motor 24. A jamming action at these speeds will stall the motor 24 without damaging to the unit 19. However, an alternative to this condition is that the motor output pinion 31 can be clutched to the motor output shaft 25 but this has been found unnecessary in the existing unit.

Concerning the possibility of damaging the unit 19 by any attempt to force a setting thereof while a change of numbers is being selected by the mechanism 33, this can be prevented in either of two ways. Probably the most practical method is by employing reasonably strong components and stakings consistent with normal instrument practice and by the use of the setting knob 23 which is not unduly large for the very light setting frictions. An alternative method would be to clutch the setting knob 23 to the setting shaft 36 so that the application of any undue force would be passed by such clutch.

Therefore, it can be seen that this invention not only provides an improved range timer having a digital timer with direct readings for the setting thereof and for a countdown readout thereof from anywhere from 1 minute to 1 hour and 59 minutes, but also this invention provides a digital timer for any purpose as well as a method making the same.

While the form and method of this invention now preferred have been described and illustrated as required by the Patent Statutes, it is to be understood that other forms and methods can be utilized and still come within the scope of the appended claims.

1. A digital timer comprising frame means, timer means carried by said frame means, drive means carried by said frame means for driving said timer means, setting means carried by said frame means to set a selected period of time of said timer means, and means for interconnecting said drive means and said timer means together to cause said drive means to drive said timer means for only said set period of time, said timer means having digital reading means for indicating the set period of time thereof, said reading means comprising two concentrically disposed different sized discs having time indicating indicia on the outer peripheries thereof, the small disc having said time indicating indicia comprising numerals from 0 to 9 to respectively represent unit minutes, the larger disc having time indicating indicia comprising numerals from 0 to 5 and 1:0 to 1:5 to respectively represent tens of minutes coupled respectively with no hours and 1 hour whereby said timer means can be set for a desired period of time between 1 minute and 1 hour and 59 minutes.

2. A digital timer as set forth in claim 1 wherein said setting means causes said reading means to directly indicate the setting of said timer means as said setting means selects said period of time that said timer is to run.

3. A digital timer means as set forth in claim 2 wherein said timer means causes said reading means to provide a countdown readout of the set period of time as the same is elapsing.

4. A digital timer as set forth in claim 1 wherein said frame means has a plate means disposed in front of said discs, said plate means having an opening therein that exposes adjacent sections of said outer peripheries of said discs for time indicating purposes.

5. A digital timer as set forth in claim 1 wherein said setting means comprises a rotatable member, said rotatable member being rotatable in either direction for time period setting purposes.

6. A digital timer as set forth in claim 1 wherein time period termination alarm means is carried by said frame means for sounding the termination of said selected time period, and push button means carried by said frame means for turning off said alarm means.

7. A digital timer as set forth in claim 6 wherein said push button means comprises part of said setting means of said timer means.

* * * * *